US011783847B2

(12) United States Patent
Sivaraman Narayanaswamy et al.

(10) Patent No.: US 11,783,847 B2
(45) Date of Patent: Oct. 10, 2023

(54) SYSTEMS AND METHODS FOR UNSUPERVISED AUDIO SOURCE SEPARATION USING GENERATIVE PRIORS

(71) Applicant: Arizona Board of Regents on Behalf of Arizona State Univesity, Tempe, AZ (US)

(72) Inventors: Vivek Sivaraman Narayanaswamy, Tempe, AZ (US); Jayaraman Thiagarajan, Dublin, CA (US); Rushil Anirudh, San Francisco, CA (US); Andreas Spanias, Tempe, AZ (US)

(73) Assignees: Lawrence Livermore National Security, LLC, Livermore, CA (US); Arizona Board of Regents on Behalf of Arizona State University, Tempe, AZ (US)

( * ) Notice: Subject to any disclaimer, the term of this patent is extended or adjusted under 35 U.S.C. 154(b) by 160 days.

(21) Appl. No.: 17/564,502

(22) Filed: Dec. 29, 2021

(65) Prior Publication Data

US 2022/0208204 A1 Jun. 30, 2022

Related U.S. Application Data

(60) Provisional application No. 63/131,408, filed on Dec. 29, 2020.

(51) Int. Cl.
*G10L 21/028* (2013.01)
*G10L 25/30* (2013.01)
(Continued)

(52) U.S. Cl.
CPC ..... *G10L 21/028* (2013.01); *G10L 25/18* (2013.01); *G10L 25/30* (2013.01); *H04R 29/008* (2013.01)

(58) Field of Classification Search
CPC ..... G10L 21/028
See application file for complete search history.

(56) References Cited

U.S. PATENT DOCUMENTS

2010/0138010 A1* 6/2010 Aziz Sbai ..... G10H 1/0008 700/94
2013/0121506 A1* 5/2013 Mysore ..... G10L 21/028 381/94.1
(Continued)

FOREIGN PATENT DOCUMENTS

GB 2582995 A * 10/2020 ..... G02B 27/017
WO WO-2014195359 A1 * 12/2014 ..... G10L 13/10
WO WO-2016133785 A1 * 8/2016 ..... G06F 3/0484

OTHER PUBLICATIONS

A. Spanias, T. Painter, and V. Atti, Audio signal processing and coding. John Wiley & Sons, 2006.
(Continued)

*Primary Examiner* — Olisa Anwah
(74) *Attorney, Agent, or Firm* — POLSINELLI PC

(57) ABSTRACT

Various embodiments of a system and associated method for audio source separation based on generative priors trained on individual sources. Through the use of projected gradient descent optimization, the present approach simultaneously searches in the source-specific latent spaces to effectively recover the constituent sources. Though the generative priors can be defined in the time domain directly, it was found that using spectral domain loss functions leads to good-quality source estimates.

20 Claims, 5 Drawing Sheets

(51) Int. Cl.
*G10L 25/18* (2013.01)
*H04R 29/00* (2006.01)

(56) References Cited

U.S. PATENT DOCUMENTS

| | | | | |
|---|---|---|---|---|
| 2013/0132077 | A1* | 5/2013 | Mysore | G10L 21/028 704/E15.039 |
| 2016/0071526 | A1* | 3/2016 | Wingate | G01S 3/807 704/233 |
| 2017/0236531 | A1* | 8/2017 | Koretzky | H04S 5/00 381/17 |
| 2018/0122403 | A1* | 5/2018 | Koretzky | G10L 21/028 |
| 2020/0342234 | A1* | 10/2020 | Gan | G06V 20/46 |
| 2021/0074267 | A1* | 3/2021 | Higurashi | G10H 1/0008 |
| 2021/0174817 | A1* | 6/2021 | Grauman | G10L 25/51 |
| 2021/0183401 | A1* | 6/2021 | Narayanaswamy | G06N 3/08 |
| 2022/0101821 | A1* | 3/2022 | Uhlich | G10L 21/0272 |
| 2022/0101869 | A1* | 3/2022 | Wichern | G10L 25/51 |
| 2022/0180882 | A1* | 6/2022 | Wang | G06N 3/088 |

OTHER PUBLICATIONS

A. Spanias, "Advances in speech and audio processing and cod¬ing," 6th IEEE International Conference on Information, Intelli¬gence, Systems and Applications (IISA), pp. 1-2, Jul. 2015.

S. Makino, S. Araki, R. Mukai, and H. Sawada, "Audio source separation based on independent component analysis," in IEEE International Symposium on Circuits and Systems, vol. 5, pp. May 2004.

J. Karhunen, L. Wang, and R. Vigario, "Nonlinear pca type ap¬proaches for source separation and independent component analy¬sis," International Conference on Neural Networks (ICNN), vol. 2, pp. 995-1000, 1995.

J. J. Thiagarajan, K. N. Ramamurthy, and A. Spanias, "Mixing matrix estimation using discriminative clustering for blind source separation," Digital Signal Processing, vol. 23, No. 1, pp. 9-18, 2013.

L. Wang, J. D. Reiss, and A. Cavallaro, "Over-determined source separation and localization using distributed micro¬phones," IEEE/ACM Transactions on Audio, Speech, and Lan¬guage Processing, vol. 24, No. 9, pp. 1573-1588, 2016.

D. Stoller, S. Ewert, and S. Dixon, "Wave-u-net: A multi-scale neural network for end-to-end audio source separation," arXiv preprint arXiv:1806.03185, 2018.

Y. Luo and N. Mesgarani, "Conv-tasnet: Surpassing ideal time-frequency magnitude masking for speech separation," IEEE/ACM Transactions on Audio, Speech, and Language Processing, vol. 27, No. 8, pp. 1256-1266, 2019.

F. Lluis, J. Pons, and X. Serra, "End-to-end music source separation: is it possible in the waveform domain?" arXiv preprint arXiv:1810.12187, 2018.

N. Takahashi, N. Goswami, and Y. Mitsufuji, "Mmdenselstm: An efficient combination of convolutional and recurrent neural net¬works for audio source separation," pp. 106-110, 2018.

E. M. Grais, D. Ward, and M. D. Plumbley, "Raw multi¬channel audio source separation using multi-resolution convolu¬tional auto-encoders," pp. 1577-1581, 2018.

A. Defossez, N. Usunier, L. Bottou, and F. Bach, "Demucs: Deep extractor for music sources with extra unlabeled data remixed," arXiv preprint arXiv:1909.01174, 2019.

T. Virtanen, "Sound source separation using sparse coding with temporal continuity objective." ICMC, pp. 231-234, 2003.

D. Ulyanov, A. Vedaldi, and V. Lempitsky, "Deep image prior," IEEE Conference on Computer Vision and Pattern Recognition, pp. 9446-9454, 2018.

Y. Tian, C. Xu, and D. Li, "Deep audio prior," arXiv preprint arXiv:1912.10292, 2019.

I. Goodfellow, J. Pouget-Abadie, M. Mirza, B. Xu, D. Warde-Farley, S. Ozair, A. Courville, and Y. Bengio, "Generative adversarial nets," Advances in neural information processing systems, pp. 2672-2680, 2014.

A. Bora, A. Jalal, E. Price, and A. G. Dimakis, "Compressed sensing using generative models," 34th International Conference on Machine Learning (ICML), vol. 70, pp. 537-546, 2017.

J.-Y. Zhu, T. Park, P. Isola, and A. A. Efros, "Unpaired image-to-image translation using cycle-consistent adversarial networks," IEEE international conference on computer vision (ICCV), pp. 2223-2232, 2017.

V. Shah and C. Hegde, "Solving linear inverse problems using gan priors: An algorithm with provable guarantees," 2018 IEEE International Conference on Acoustics, Speech and Signal Processing (ICASSP), pp. 4609-4613, 2018.

R. Anirudh, J. J. Thiagarajan, B. Kailkhura, and P.-T. Bremer, "Mimicgan: Robust projection onto image manifolds with corruption mimicking," International Journal of Computer Vision, pp. 1-19, 2020.

C. Donahue, J. McAuley, and M. Puckette, "Adversarial audio synthesis," arXiv preprint arXiv:1802.04208, 2018.

S. Mika, B. Schoplkopf, A. J. Smola, K.-R. Mupller, M. Scholz, and G. Raptsch, "Kernel pca and de-noising in feature spaces," Advances in neural information processing systems, pp. 536-542, 1998.

C. Fevotte, E. Vincent, and A. Ozerov, "Single-channel audio source separation with nmf: Divergences, constraints and algorithms," Audio Source Separation, pp. 1-24, 2018.

O. Ronneberger, P. Fischer, and T. Brox, "U-net: Convolutional networks for biomedical image segmentation," International Conference on Medical image computing and computer-assisted intervention, pp. 234-241, 2015.

A. Radford, L. Metz, and S. Chintala, "Unsupervised representation learning with deep convolutional generative adversarial networks," arXiv preprint arXiv:1511.06434, 2015.

I. Gulrajani, F. Ahmed, M. Arjovsky, V. Dumoulin, and A. C. Courville, "Improved training of wasserstein gans," Advances in neural information processing systems, pp. 5767-5777, 2017.

A. Defossez, N. Zeghidour, N. Usunier, L. Bottou, and F. Bach, "Sing: Symbol-to-instrument neural generator," Advances in Neural Information Processing Systems, pp. 9041-9051, 2018.

X. Zhang, R. Ng, and Q. Chen, "Single image reflection separation with perceptual losses," IEEE Conference on Computer Vision and Pattern Recognition (CVPR), pp. 4786-4794, 2018.

P. Warden, "Speech commands: A dataset for limited-vocabulary speech recognition," arXiv preprint arXiv:1804.03209, 2018.

M. Spiertz and V. Gnann, "Source-filter based clustering for monaural blind source separation," Proceedings of the 12th International Conference on Digital Audio Effects, 2009.

T. Virtanen, "Monaural sound source separation by nonnegative matrix factorization with temporal continuity and sparseness criteria," IEEE transactions on audio, speech, and language processing, vol. 15, No. 3, pp. 1066-1074, 2007.

P. Morgado, N. Nvasconcelos, T. Langlois, and O. Wang, "Self-supervised generation of spatial audio for 360 video," Advances in Neural Information Processing Systems, pp. 362-372, 2018.

F.-R. Stopter, A. Liutkus, and N. Ito, "The 2018 signal separation evaluation campaign," Latent Variable Analysis and Signal Separation: 14th International Conference, LVA/ICA, Surrey, UK, pp. 293-305, 2018.

F. Pedregosa, G. Varoquaux, A. Gramfort, V. Michel, B. Thirion, O. Grisel, M. Blondel, P. Prettenhofer, R. Weiss, V. Dubourg, J. Vanderplas, A. Passos, D. Cournapeau, M. Brucher, M. Perrot, and E. Duchesnay, "Scikit-learn: Machine learning in Python," Journal of Machine Learning Research, vol. 12, pp. 2825-2830, 2011.

* cited by examiner

SYSTEMS AND METHODS FOR UNSUPERVISED AUDIO SOURCE SEPARATION USING GENERATIVE PRIORS

CROSS-REFERENCE TO RELATED APPLICATIONS

This is a non-provisional application that claims benefit to U.S. Provisional Patent Application Ser. No. 63/131,408 filed 29 Dec. 2020, which is herein incorporated by reference in its entirety.

GOVERNMENT SUPPORT

This invention was made with government support under 1540040 awarded by the National Science Foundation. The government has certain rights in the invention.

FIELD

The present disclosure generally relates to audio source separation, and in particular, to a system and associated methods for unsupervised audio source separation.

BACKGROUND

Audio source separation, the process of recovering constituent source signals from a given audio mixture, is a key component in downstream applications such as audio enhancement and music information retrieval. Typically formulated as an inverse optimization problem, source separation has been traditionally solved using a broad class of matrix factorization methods, e.g., Independent Component Analysis (ICA) and Principal Component Analysis (PCA). While these methods are known to be effective in over-determined scenarios, i.e. the number of mixture observations is greater than the number of sources, they are severely challenged in underdetermined settings. Consequently, in the recent years, supervised deep learning based solutions have become popular for under-determined source separation. These approaches can be broadly classified into time domain and spectral domain methods, and often produce state-of-the-art performance on standard benchmarks. Despite their effectiveness, there is a fundamental drawback with supervised methods. In addition to requiring access to large number of observations, a supervised source separation model is highly specific to the given set of sources and the mixing process, consequently requiring complete re-training when those assumptions change. This motivates a strong need for the next generation of unsupervised separation methods that can leverage the recent advances in data-driven modeling, and compensate for the lack of labeled data through meaningful priors.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
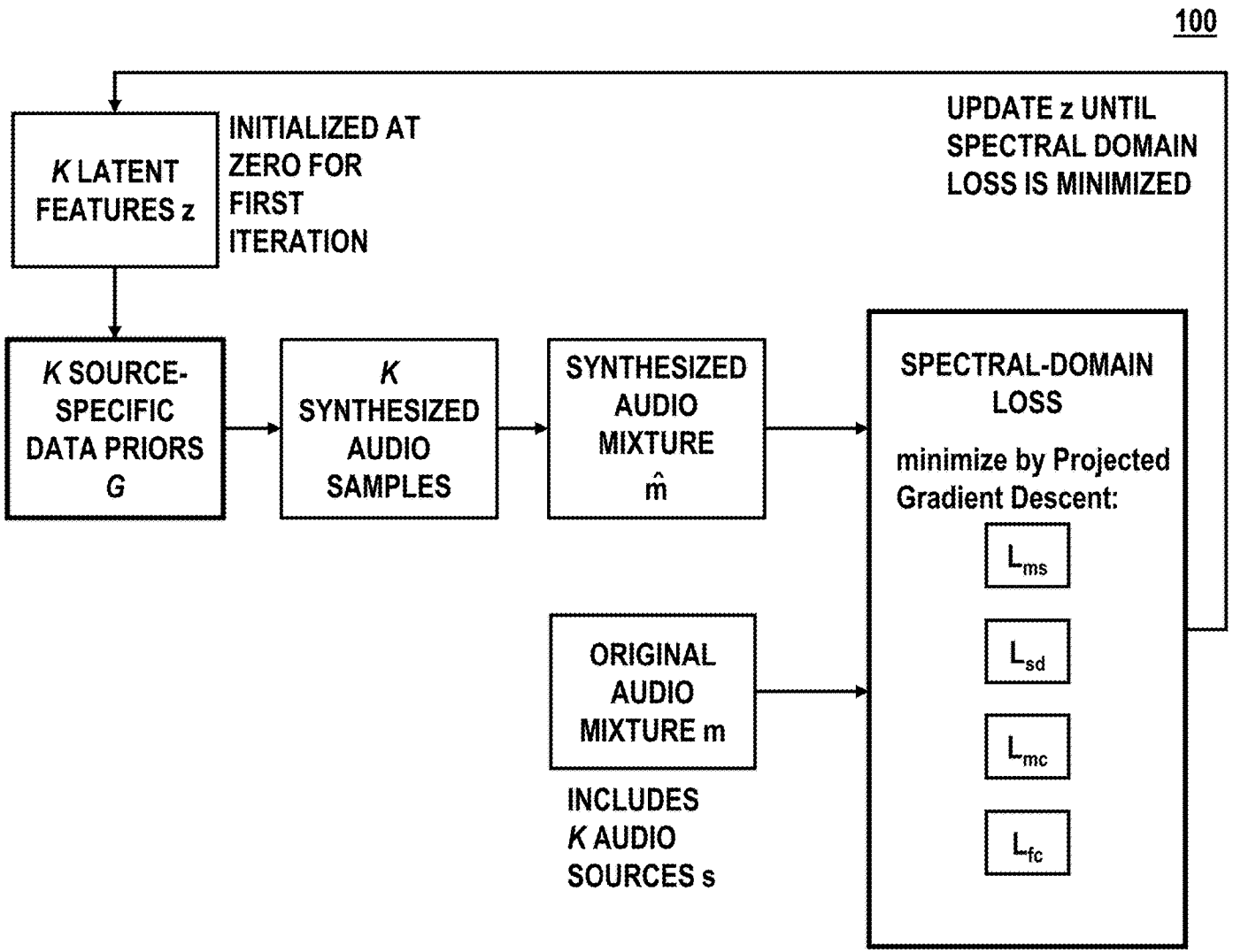
FIG. 1 is a simplified block diagram showing a system for unsupervised audio source separation using generative priors.

In the present disclosure, an alternative approach is considered for under-determined audio source separation based on data priors defined via deep generative models, and in particular using generative adversarial networks (GANs). It is hypothesized that such a data prior will produce higher quality source estimates by enforcing the estimated solutions to belong to a data manifold. While GAN priors have been successfully utilized in inverse imaging problems such as denoising, deblurring, compressed recovery etc., their use in audio source separation has not been studied yet—particularly in the context of audio. In this disclosure, an unsupervised approach for audio source separation is discussed that utilizes multiple audio source-specific priors and employs Projected Gradient Descent (PGD)-style optimization with carefully designed spectral-domain loss functions. Since the present approach is an inference-time technique, it is extremely flexible and general such that it can be used even with a single mixture. The time-domain based WaveGAN model is utilized to construct the source-specific priors, and interestingly, it was found that using spectral losses for the inversion leads to superior quality results. Using standard benchmark datasets (spoken digit audio (SC09), drums and piano), the present system is evaluated under the assumption that mixing process is known. From rigorous empirical study, it was found that the proposed data prior is consistently superior to other commonly adopted priors, including the recent deep audio prior. Referring to the drawings, embodiments of a system for audio source separation based on data priors are illustrated and generally indicated as 100 in FIGS. 1-5.

Designing Priors for Inverse Problems

Despite the advances in learning methods for audio processing, under-determined source separation remains a critical challenge. Formally, in the present system, the number m of mixtures or observations $m \ll n$, where n is the number of sources. One method to make this ill-defined problem tractable is to place appropriate priors to restrict the solution space. Existing approaches can be broadly classified into the following categories:

Statistical Priors. This includes the class of matrix factorization methods conventionally used in source separation. For example in ICA, the assumptions of non-Gaussianity are enforced as well as statistical independence between the sources. On the other hand, PCA enforces statistical independence between the sources by linear projection onto mutually orthogonal subspaces. KernelPCA induces the same prior in a reproducing kernel Hilbert space. Another popular approach is Non-negative matrix factorization (NMF), which places a non-negativity prior on the estimated basis matrices. Finally, a sparsity prior ($l_1$) placed either in the observed domain or in the expansion via an appropriate basis set or a dictionary has also been widely adopted to regularize this problem.

Structural Priors. Recent advances in deep neural network design have shown that certain carefully chosen networks have the innate capability to effectively regularize or behave as a prior to solve ill-posed inverse problems. These networks essentially capture the underlying statistics of data, independent of the task-specific training. These structural priors have produced state-of-the-art performance in inverse imaging problems.

GAN Priors. A third class of methods have relied on priors defined via generative models, e.g. GANs. GANs can learn parameterized non-linear distributions p(X; z) from a sufficient amount of unlabeled data X, where z denotes the latent variables of the model. In addition to readily sampling from trained GAN models, they can be leveraged as an effective prior for X. Popularly referred to as GAN priors, they have been found to be highly effective in challenging inverse problems. In its most general form, when one attempts to recover the original data x from its corrupted version $\tilde{x}$ (observed), one can maximize the posterior distribution $p(X=x|\tilde{x}; z)$ by searching in the latent space of a pre-trained GAN. Since this posterior distribution cannot be expressed analytically, in practice, an iterative approach such as Projected Gradient Descent (PGD) is utilized to estimate the latent features $\hat{z}$ followed by sampling from the generator, i.e. $p(X; z=\hat{z})$.

In the present disclosure, GAN priors are used to solve the problem of under-determined source separation. Existing solutions with data priors utilize a single GAN model to perform the inversion process. However, by design, source separation requires the simultaneous estimation of multiple disparate source signals. While one can potentially build a generative model that can jointly characterize all sources, it will require significantly large amounts of data. Hence, the use of source-specific generative models and generalizing the PGD optimization with multiple GAN priors are advocated. In addition to reducing the data needs, this approach provides the crucial flexibility of handling new sources, without the need for retraining the generative models for all sources. From studies performed, it was found that utilizing multiple GAN priors $\{\mathcal{G}_i | i=1 \ldots K\}$, is highly effective for under-determined source separation. In particular, a popular waveform synthesis model WaveGAN is chosen as GAN prior $\mathcal{G}_i$ as it was found that the generated samples are of high perceptual quality. While time domain GAN prior models are utilized, it was found that spectral domain loss functions are critical in source estimation using PGD.

Approach

Figure 2:
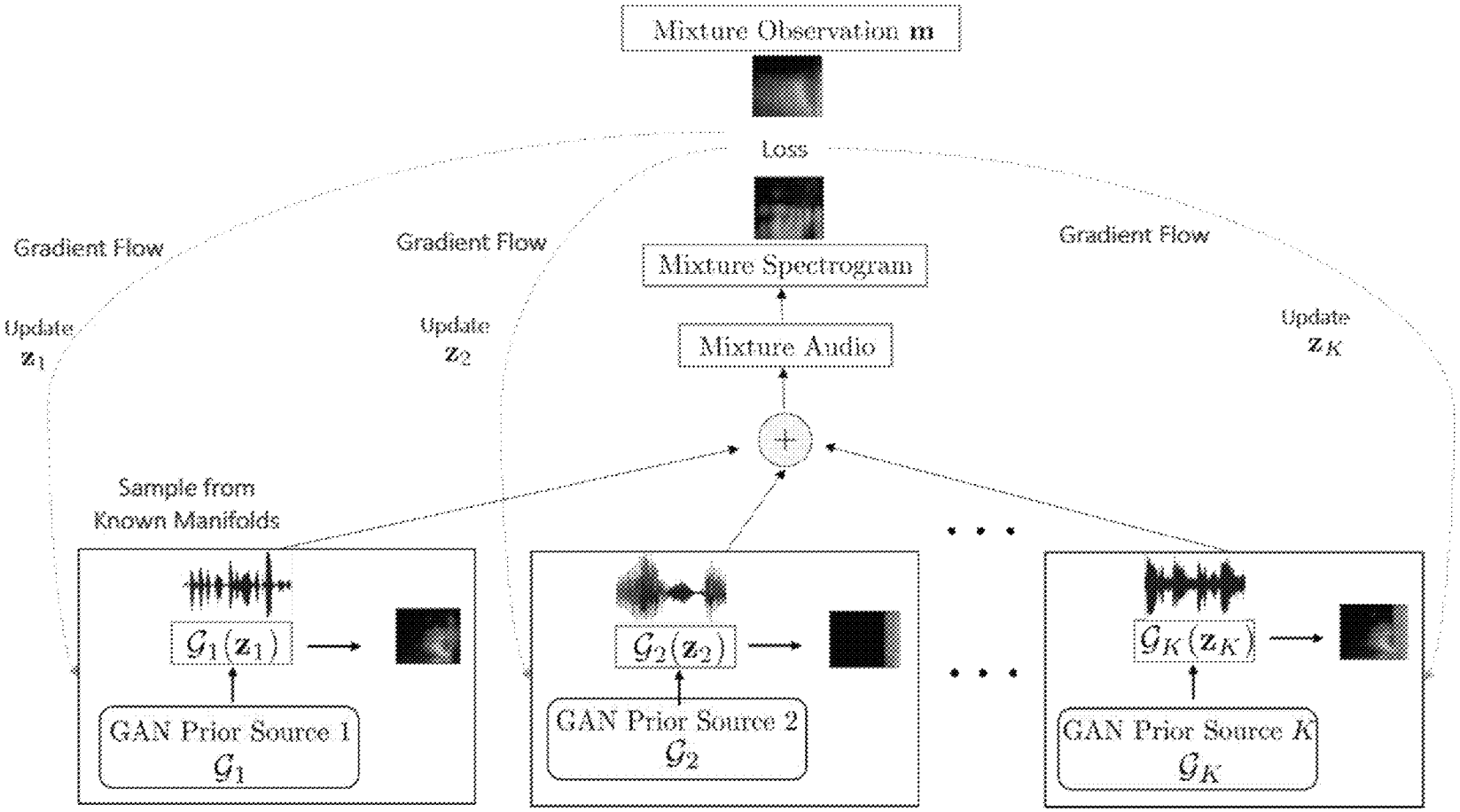
FIG. 2 is a simplified illustration showing operation of the system of FIG. 1.

FIGS. 1 and 2 provide an overview of the present system 100 for unsupervised audio source separation. Audio source separation involves the process of recovering constituent audio sources $\{s_i \in \mathbb{R}^d | i=1 \ldots K\}$ from a given audio mixture $m \in \mathbb{R}^d$, where K is the total number of audio sources and d is the number of time steps. In this disclosure, without loss of generality, the audio source and mixtures are assumed to be mono-channel and the mixing process is assumed to be a sum of sources i.e. $m=\Sigma_{i=1}^{K} s_i$. Here, the process of source separation is reformulated by first estimating source-specific latent features $z_i^*$ followed by sampling from respective source-specific data prior generators. There are two key ingredients that are critical to the performance of the present approach: (i) choice of a good quality GAN Prior for every source and (ii) carefully chosen loss functions to drive the PGD optimization. Here, source-specific audio samples are sampled from the respective source-specific data priors and additive mixing is performed to reconstruct the mixture i.e. $\Sigma_{i=1}^{K} \mathcal{G}_i(z_i)$. The mixture is then processed to obtain a corresponding spectrogram. In addition, source level spectrograms are also computed. Source separation is performed by efficiently searching the latent space of the source-specific priors $\mathcal{G}_i$ using Projected Gradient Descent optimizing a spectral domain loss function $\mathcal{L}$ across a plurality of time iterations. More formally, for a single mixture m, an objective function is given by:

$$\{z_i^*\}_{i=1}^{K} = \arg \min_{z_1, z_2 \cdots z_K} \mathcal{L}(\hat{m}, m) + \mathcal{R}(\{\mathcal{G}_i(z_i)\}), \tag{1}$$

where the first term measures the discrepancy between the true and estimated mixtures and the second term is an optional regularizer on the estimated sources. In every PGD iteration, a projection $\mathcal{P}$ is performed, where the $\{z_i\}_{i=1}^{K}$ are constrained to their respective manifolds. Upon completion of this optimization, the sources can be obtained as $\hat{s}_i^* = \mathcal{G}_i(z_i^*)$, $\forall i$.

WaveGAN for Data Prior Construction

WaveGAN is a popular generative model capable of synthesizing raw waveform audio. It has exhibited success in producing audio from different domains such as speech and musical instruments. Both the generator and discriminator of the WaveGAN model are similar in construction to DCGAN with certain architectural changes to support audio generation. The generator $\mathcal{G}$ transforms the latent features $z \in \mathbb{R}^{d_z}$ where $d_z=100$ from a uniform distribution in [−1, 1], to produce waveform audio $\mathcal{G}(z)$ of dimension d=16384 which is approximately of 1 s duration at a sampling rate of 16 kHz. The discriminator $\mathcal{D}$ regularized using phase shuffle learns to distinguish between the real and synthesized samples. The WaveGAN is trained to optimize Wasserstein loss with gradient penalty (WGAN-GP). Given the ability of WaveGAN to synthesize high quality audio, the pre-trained generator of WaveGAN was used to define the GAN Prior. In the present formulation, instead of using a single GAN Prior trained jointly for all sources, K independent source-specific priors are constructed.

Algorithm 1: Proposed Approach.

```
Input:        Unlabeled mixture m, No. of sources K ,
              Pre-trained GAN Priors {G_i}_{i=1...K}
Output:       Estimated sources {ŝ_i*}_{i=1...K}
Initialization: {ẑ_i}_{i=1...K} = 0 ∈ ℝ^{d_z}
for t ← to T do
    |         m̂ = Σ_{i=1}^{K} G_i(ẑ_i)
    |         Compute source level and mixture spectrograms
    |         Compute loss L using 6
    |         ẑ_i ← ẑ_i − η∇_z(L) ∀i = 1 ... K
    |         ẑ_i P(ẑ_i) P projects {z_i}_{i=1...K} onto the
    |             manifold, i.e., clipped to [−1, 1]
end
return {ŝ_i*} = G_i(z_i*), ∀i
```

Losses

In order to obtain high-quality source estimates using GAN priors, the present disclosure describes a combination of spectral-domain losses. Though one can utilize time-domain metrics such as the Mean-Squared Error (MSE) to compare the observed and synthesized mixtures, it was found that even small variations in the phases of sources estimated from the priors can lead to higher error values. This in turn can misguide the PGD optimization process and may lead to poor convergence.

Multiresolution Spectral Loss ($\mathcal{L}_{ms}$)

This loss term measures the $\ell_1$-norm between log magnitudes of the reconstructed spectrogram and the input spectrogram at L spatial resolutions. This is used to enforce perceptual closeness between the two mixtures at varying spatial resolutions. Denoting m as the input mixture and ml as the estimated mixture, the loss $\mathcal{L}_{ms}$ is defined as:

$$\mathcal{L}_{ms} = \sum_{l=1}^{L} \left\| \log\left(1 + |STFT^{l}(m)|^2\right) - \log\left(1 + |STFT^{l}(\hat{m})|^2\right) \right\|_1, \tag{2}$$

where $|STFT^{l}(\bullet)|$ represents the magnitude spectrograms at the $l^{th}$ spatial resolution and L=3. The magnitude spectrogram is computed at different resolutions by performing a simple average pooling operation with bilinear interpolation.

Source Dissociation Loss ($\mathcal{L}_{sd}$)

Minimizing Source Dissociation Loss ($\mathcal{L}_{sd}$), defined as the aggregated gradient similarity between the spectrograms of the estimated sources, enforces them to be systematically different. This is defined as a product of the normalized gradient fields of the log magnitude spectrograms computed at L spatial resolutions. In the case where there are K constituent sources, $\mathcal{L}_{sd}$ is computed between every pair of sources. Formally:

$$\mathcal{L}_{sd} = \sum_{i=1}^{K} \sum_{j=i+1}^{K} \sum_{l=1}^{L} \left\| \Psi\left(\log\left(1 + |STFT^{l}(\mathcal{G}_i(\hat{z}_i))|^2\right), \log\left(1 + |STFT^{l}(\mathcal{G}_j(\hat{z}_j))|^2\right)\right) \right\|_F, \tag{3}$$

where $\Psi(x,y)=\tanh(\lambda_1|\nabla x|)\odot \tanh(\lambda_2|\nabla y|)$. ($\odot$ represents element-wise multiplication) and L=3. The weights $\lambda 1$ and $\lambda 2$ are set at $$\lambda_1 = \frac{\sqrt{|\nabla y|_F}}{|\nabla x|_F} \text{ and } \lambda_2 = \lambda_2 = \frac{\sqrt{|\nabla x|_F}}{|\nabla y|_F}.$$

Mixture Coherence Loss ($\mathcal{L}_{mc}$)

Along with $\mathcal{L}_{ms}$, $\mathcal{L}_{mc}$, defined using gradient similarity between original and reconstructed mixtures, ensures that PGD optimization produces meaningful reconstructions:

$$\mathcal{L}_{mc} = -\sum_{l=1}^{L} \left\| \Psi\left(\log\left(1 + |STFT^{l}(m)|^2\right), \log(1 + |STFT^{l}(\hat{m}))|^2\right)\right) \right\|_F \tag{4}$$

Frequency Consistency Loss ($\mathcal{L}_{fc}$)

Frequency Consistency Loss ($\mathcal{L}_{fc}$) helps improve perceptual similarity between the magnitude spectrograms of the input and synthesized mixtures by constraining components within a particular temporal bin of the spectrograms to remain consistent over the entire frequency range, i.e.

$$\mathcal{L}_{fc} = \sum_{t=1}^{T} \sum_{f=1}^{F} \frac{\log(1 + |STFT(m)[t, f]|)}{\log(1 + |STFT(\hat{m})[t, f]|)}. \tag{5}$$

The overall loss function for the source separation system 100 is thus obtained as:

$$\mathcal{L} = \beta_1 \mathcal{L}_{ms} + \beta_2 \mathcal{L}_{sd} + \beta_3, \mathcal{L}_{mc} + \beta_4 \mathcal{L}_{fc} \tag{6}$$

Figure 4:
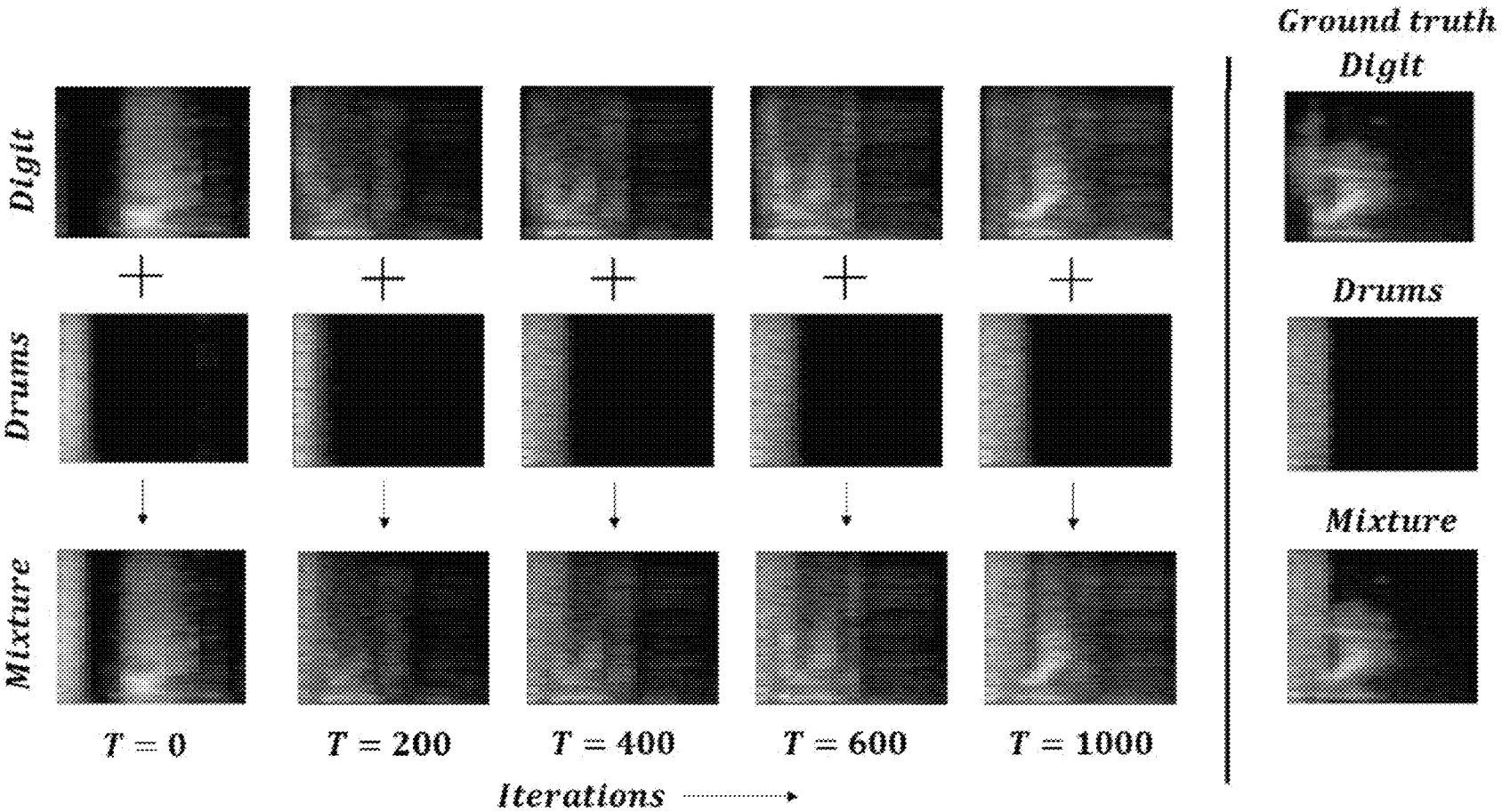
FIG. 4 is a graphical representation showing demonstration of the system of FIG. 1 using a digit-drum example.

Through hyperparameter search it was identified that $\beta_1$=0.8, $\beta_2$=0.3, $\beta_3$=0.1, $\beta_4$=0.4 to be effective during experimentation. Note, spectrograms were obtained by computing the Short Time Fourier Transform (STFT) on the waveform in frames of length 256, hop size of 128 and FFT length of 256. A methodology procedure for the present approach is shown in Algorithm 1. FIG. 4 illustrates the progressive estimation of the unknown sources using the system 100.

Figure 3:
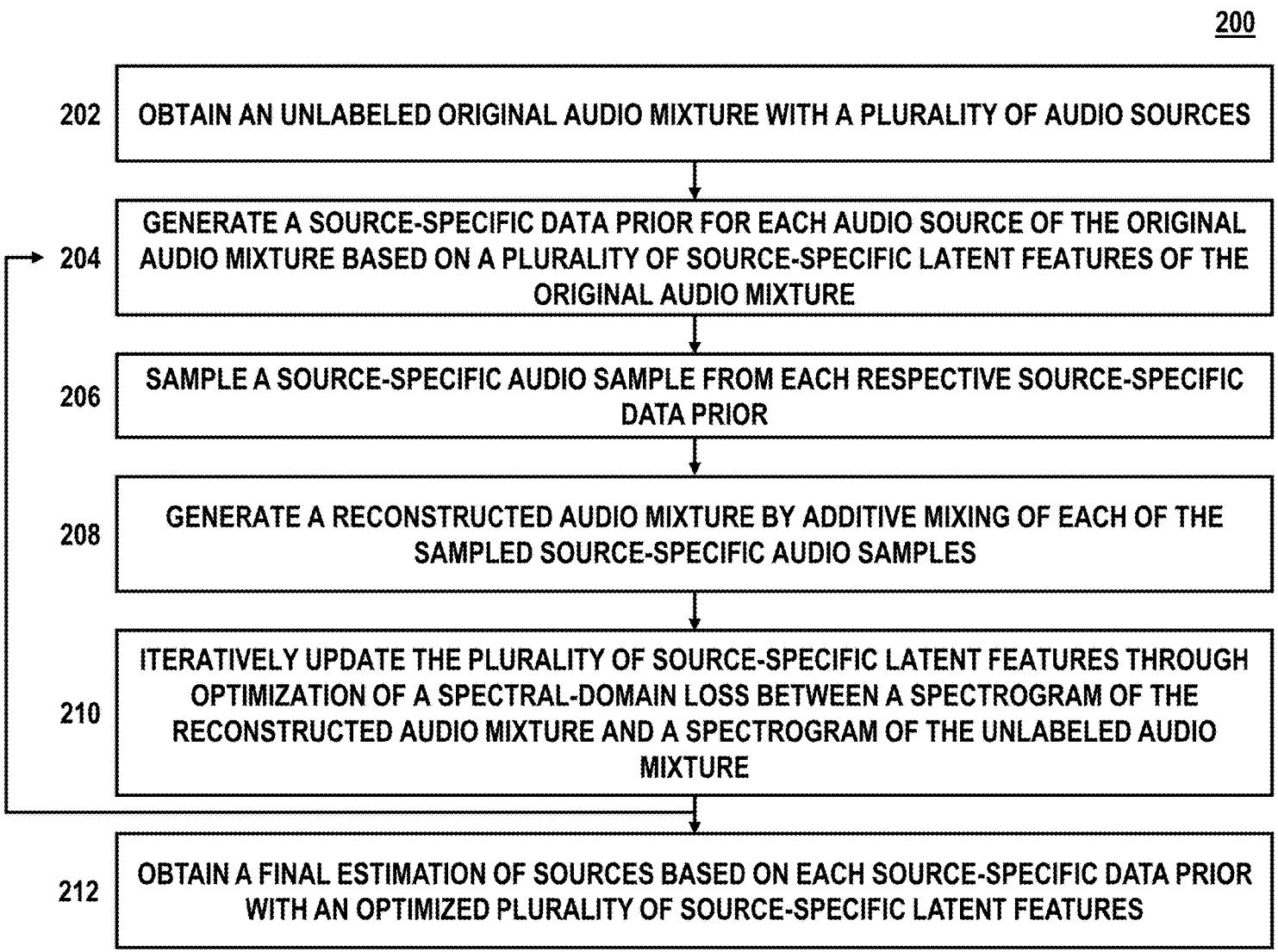
FIG. 3 is a process flow illustrating a method for unsupervised audio source separation according to the system of FIG. 1.

Referring to FIG. 3, a method 200 for audio source separation executed by the system 100 of FIG. 1 is provided. At block 202 of method 200, the system 100 obtains an unlabeled original audio mixture m with K audio sources $s_i$ $\forall i=1 \ldots K$. At block 204, the system 100 generates a source-specific data prior G; for each audio source $s_i$ of the original audio mixture m based on a plurality of source-specific latent features $z_i$ $\forall i=1 \ldots K$ of the original audio mixture m. In some embodiments, the plurality of source-specific latent features $z_i$ are initialized to zero such that $\{z_i\}_{i=1 \ldots K}=0 \in \mathbb{R}^{d_z}$ for a first update iteration, and are updated with subsequent steps until each source-specific latent feature $z_i$ of the plurality of source-specific latent features $z_i$ is accurate to the corresponding audio source $s_i$ of the original mixture m.

At block 206, the system 100 samples an audio sample from each respective source-specific data prior $z_i$ based on the current plurality of source-specific latent features $z_i$. At block 208, the system 100 generates a reconstructed audio mixture $\hat{m}$ by additive mixing of each synthesized audio sample of the plurality of synthesized audio samples.

At block 210, the system 100 iteratively updates the plurality of source-specific latent features $z_i$ through optimization of a spectral-domain loss (Eq. 6) between a spectrogram of the reconstructed audio mixture $\hat{m}$ and a spectrogram of the original audio mixture m. This involves minimization of a combination of several losses including Multiresolution Spectral Loss, Source Dissociation Loss, Mixture Coherence Loss, and Frequency Consistency Loss. As discussed above, the optimization process to minimize the combination of losses is performed by the system 100 using Projected Gradient Descent. Upon completion of this step, the updated plurality of source-specific latent features $z_i$ is used again to generate new source-specific data priors and corresponding source-specific audio samples according to block 204. This process is repeated for T iterations or until convergence. At block 212, the system 100 obtains a final estimation of audio sources $s_i$ based on each source-specific data prior $G_i$ with an optimized plurality of source-specific latent features $z_i$.

Empirical Evaluation

In this section, the system 100 is evaluated on two-source and three-source separation experiments on the publicly available Spoken Digit (SC09), drum sounds and piano datasets. The SC09 dataset is a subset of the Speech Commands dataset containing spoken digits (0-9) each of duration ~1 s at 16 kHz from a variety of speakers recorded under different acoustic conditions. The drum sounds dataset contains single drum hit sounds each of duration ~1 s at 16 kHz. The piano dataset contains piano music (Bach compositions) each of duration (>50 s) at 48 kHz.

WaveGAN Training. WaveGAN models were trained on normalized 1 s slices (i.e d=16384 samples) of the SC09 (Digit), Drums and Piano train datasets resampled to 16 kHz respectively. All the models were trained using batches of size 128. The generator and discriminator were optimized using WGAN-GP loss with an Adam optimizer and learning rate $1e^{-4}$ for 3000 epochs. The trained generator models were used to construct the GAN priors.

Setup. For the task of two source separation (K=2), experiments were conducted on three possible mixture combinations: (i) Digit-Piano, (ii) Drums-Piano and (iii) Digit-Drums. In order to create the input mixture for every combination, normalized 1 s audio slices were randomly sampled (with replacement) from the respective test datasets, 1000 mixtures were obtained through a simple additive mixing process. Similarly, 1000 mixtures were obtained for the case of K=3, i.e., on the combination, Digit-Drums-Piano. In each case, the PGD optimization was performed using Eq. 6 for 1000 iterations with the ADAM optimizer and learning rate of $5e^{-2}$ to infer source specific latent features $\{z_i\}_{i=1 \ldots K}$. The estimated sources are then obtained as $\{\mathcal{G}_i(z_i^*)\}_{i=1 \ldots K}$. Though the choice of initialization for $z_i$ is known to be critical for PGD optimization, it was found that setting $\{z_i\}_{i=1 \ldots K}=0 \in \mathbb{R}^{d_z}$ was $\mathbb{R}$ effective.

Evaluation Metrics. Following standard practice, three different metrics were used—(i) mean spectral SNR, a measure of the quality of the spectrogram reconstruction; (ii) mean RMS envelope distance between the estimated and true sources; and (iii) mean signal-interference ratio (SIR) to quantify the interference caused by one estimated source on another.

TABLE 1

Performance metrics averaged across 1000 cases for the Digit-Piano (K = 2) experiment (While higher Spectral SNR and SIR are better, lower RMS Env. Distance is better).

| | Spectral SNR (dB) | | RMS Env. Distance | | SIR (dB) | |
|---|---|---|---|---|---|---|
| Method | Digit | Piano | Digit | Piano | Digit | Piano |
| FastICA | −2.13 | −13.45 | 0.22 | 0.61 | −4.12 | −0.66 |
| PCA | −2.04 | −12.01 | 0.22 | 0.54 | −4.13 | −1.44 |
| Kernel PCA | −2.04 | −3.30 | 0.22 | 0.26 | −4.13 | −1.61 |
| NMF | −2.21 | −5.80 | 0.23 | 0.26 | −4.09 | 2.53 |
| DAP | −1.77 | 2.72 | 0.22 | 0.22 | 2.20 | −3.10 |
| Proposed | 1.06 | 2.73 | 0.17 | 0.21 | 3.91 | 8.57 |

TABLE 2

Performance metrics averaged across 1000 cases for the Drums-Piano (K = 2) experiment.

| | Spectral SNR (dB) | | RMS Env. Distance | | SIR (dB) | |
|---|---|---|---|---|---|---|
| Method | Drums | Piano | Drums | Piano | Drums | Piano |
| FastICA | −5.25 | −13.52 | 0.24 | 0.61 | −6.51 | −1.45 |
| PCA | −5.19 | −12.33 | 0.24 | 0.56 | −6.53 | −2.69 |
| Kernel PCA | −5.19 | −3.36 | 0.24 | 0.25 | −6.53 | −2.02 |
| NMF | −5.39 | −5.84 | 0.24 | 0.26 | −6.59 | 3.84 |
| DAP | −4.20 | 2.97 | 0.22 | 0.21 | −21.62 | 11.22 |
| Proposed | 0.84 | 3.06 | 0.10 | 0.21 | 11.70 | 9.80 |

TABLE 3

Performance metrics averaged across 1000 cases for the Digit-Drums (K = 2) experiment.

| | Spectral SNR (dB) | | RMS Env. Distance | | SIR (dB) | |
|---|---|---|---|---|---|---|
| Method | Digit | Drums | Digit | Drums | Digit | Drums |
| FastICA | 2.91 | −21.01 | 0.13 | 0.82 | 3.10 | 0.09 |
| PCA | 2.99 | −20.00 | 0.13 | 0.77 | 3.12 | 0.02 |
| Kernel PCA | 2.99 | −10.53 | 0.13 | 0.35 | 3.12 | 0.85 |
| NMF | 3.01 | −13.75 | 0.13 | 0.39 | 3.20 | −0.98 |
| DAP | 3.59 | 0.92 | 0.14 | 0.14 | 4.24 | −11.48 |
| Proposed | 2.32 | 0.42 | 0.15 | 0.10 | 25.91 | 23.68 |

TABLE 4

Performance metrics averaged across 1000 cases for the Digit-Drums-Piano (K = 3) experiment.

| Metric | Source | FastICA | PCA | Kernel PCA | NMF | Proposed |
|---|---|---|---|---|---|---|
| Spectral SNR (dB) | Digit | −2.95 | −2.47 | −2.47 | −2.47 | 0.77 |
| | Drums | −10.8 | −19.81 | −8.1 | −12.84 | 0.64 |
| | Piano | 0.27 | 0.1 | −0.94 | 4.94 | 2.64 |
| RMS Env. Distance | Digit | 0.24 | 0.23 | 0.23 | 0.23 | 0.17 |
| | Drums | 0.4 | 0.75 | 0.28 | 0.37 | 0.1 |
| | Piano | 0.23 | 0.31 | 0.25 | 0.15 | 0.21 |
| SIR (dB) | Digit | −4.73 | −5.06 | −5.06 | −5.01 | 3.02 |
| | Drums | −6.48 | −5.51 | −1.65 | −5.69 | 10.21 |
| | Piano | 0.53 | 2.21 | −3.87 | 2.60 | 5.12 |

Results. Tables 1, 2, 3 and 4 provide a comprehensive comparison of the proposed approach against the standard baselines (FastICA, PCA, KernelPCA, NMF) as well as with the state-of-the-art unsupervised Deep-Audio-Prior. It can be observed that the system 100 significantly outperforms all the baselines in most cases, except for the Digits-Drums experiment where the present system 100 is in par with DAP. These results indicate the effectiveness of the unsupervised approach of the present system 100 on complex source separation tasks. It was found that the spectral SNR metric, which is relatively less sensitive to phase differences, is consistently high with the present system 100, indicating high perceptual similarities between estimated and the ground truth audio. Lower envelope distance estimates were also found, further emphasizing the perceptual quality of estimated sources. Finally, the significant improvements in the SIR metric are attributed to the source dissociation loss ($L_{sd}$), which enforces the estimated sources from the priors to be systematically different.

Computer-Implemented System

Figure 5:
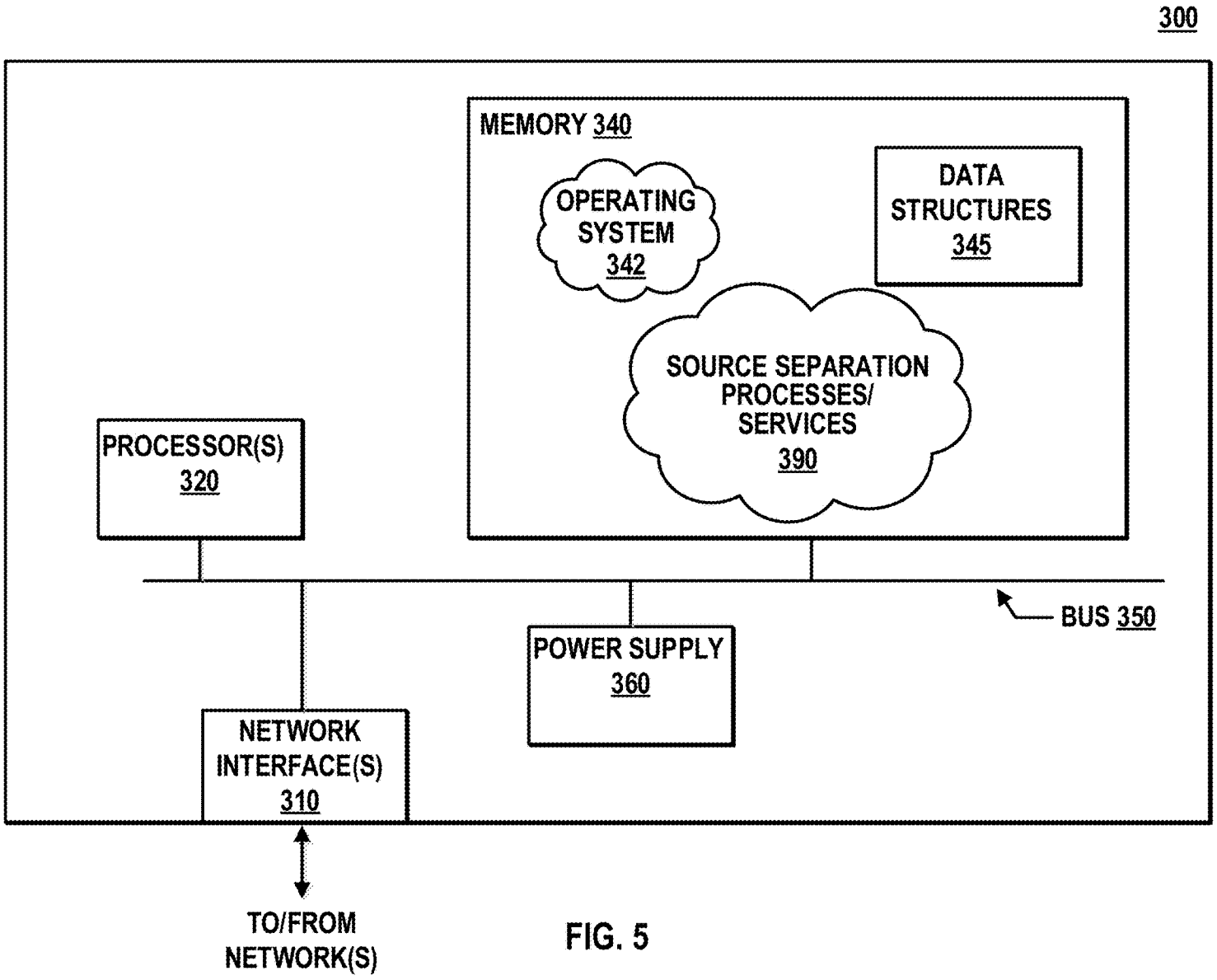
FIG. 5 is a simplified diagram showing an example computing deice and/or system for implementation of the system of FIG. 1.

FIG. 5 is a schematic block diagram of an example device 300 that may be used with one or more embodiments described herein, e.g., as a component of system 100.

Device 300 comprises one or more network interfaces 310 (e.g., wired, wireless, PLC, etc.), at least one processor 320, and a memory 340 interconnected by a system bus 350, as well as a power supply 360 (e.g., battery, plug-in, etc.).

Network interface(s) 310 include the mechanical, electrical, and signaling circuitry for communicating data over the communication links coupled to a communication network. Network interfaces 310 are configured to transmit and/or receive data using a variety of different communication protocols. As illustrated, the box representing network interfaces 310 is shown for simplicity, and it is appreciated that such interfaces may represent different types of network connections such as wireless and wired (physical) connections. Network interfaces 310 are shown separately from power supply 360, however it is appreciated that the interfaces that support PLC protocols may communicate through power supply 360 and/or may be an integral component coupled to power supply 360.

Memory 340 includes a plurality of storage locations that are addressable by processor 320 and network interfaces 310 for storing software programs and data structures associated with the embodiments described herein. In some embodiments, device 300 may have limited memory or no memory (e.g., no memory for storage other than for programs/processes operating on the device and associated caches).

Processor 320 comprises hardware elements or logic adapted to execute the software programs (e.g., instructions) and manipulate data structures 345. An operating system 342, portions of which are typically resident in memory 340 and executed by the processor, functionally organizes device 300 by, inter alia, invoking operations in support of software processes and/or services executing on the device. These software processes and/or services may include source separation processes/services 390 that includes method 200 described herein. Note that while source separation processes/services 390 is illustrated in centralized memory 340, alternative embodiments provide for the process to be operated within the network interfaces 310, such as a component of a MAC layer, and/or as part of a distributed computing network environment.

It will be apparent to those skilled in the art that other processor and memory types, including various computer-readable media, may be used to store and execute program instructions pertaining to the techniques described herein. Also, while the description illustrates various processes, it is expressly contemplated that various processes may be embodied as modules or engines configured to operate in accordance with the techniques herein (e.g., according to the functionality of a similar process). In this context, the term module and engine may be interchangeable. In general, the term module or engine refers to model or an organization of interrelated software components/functions. Further, while source separation processes/services 390 is shown as a standalone process, those skilled in the art will appreciate that this process may be executed as a routine or module within other processes.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A system for audio source separation, the system comprising:

a processor in communication with a memory, the memory including instructions which, when executed, cause the processor to:

synthesize a reconstructed audio mixture through additive mixing of a plurality of source-specific audio samples generated by a plurality of source-specific data priors based on a plurality of source-specific latent features of a plurality of audio sources of an original audio mixture;

iteratively update the plurality of source-specific latent features through optimization of a spectral-domain loss function between a spectrogram of the reconstructed audio mixture and a spectrogram of the original audio mixture; and obtain a final estimation vector of each audio source of the original audio mixture based on each source-specific data prior and the updated plurality of source-specific latent features.

2. The system of claim 1, wherein the memory includes instructions which, when executed, further cause the processor to:

generate, by a source-specific data prior generator, a source-specific data prior for each respective audio source of a plurality of audio sources of an original audio mixture based on a plurality of source-specific latent features of the original audio mixture.

3. The system of claim 2, wherein the source-specific data prior generator is a generative adversarial network configured to generate a source-specific audio sample based on the source-specific latent features of the original audio mixture.

4. The system of claim 3, wherein the memory includes instructions which, when executed, further cause the processor to:

sample an audio sample from each respective source-specific data prior of the plurality of source-specific data priors.

5. The system of claim 1, wherein the memory includes instructions which, when executed, further cause the processor to:

generate the reconstructed audio mixture by additive mixing of each of the plurality of sampled source-specific audio samples obtained using each respective source-specific data prior of the plurality of source-specific data priors.

6. The system of claim 1, wherein the memory includes instructions which, when executed, further cause the processor to:

apply projected gradient descent to the spectral domain loss function that uses the spectrogram of the reconstructed audio mixture and the spectrogram of the original audio mixture to update the plurality of source-specific latent features.

7. The system of claim 6, wherein the memory includes instructions which, when executed, further cause the processor to:

minimize a multiresolution spectral loss between log magnitudes of the spectrogram of the reconstructed audio mixture and the spectrogram of the original audio mixture at varying spatial resolutions between the original audio mixture and the reconstructed audio mixture;

minimize an aggregated gradient similarity loss between each respective spectrogram of the reconstructed audio mixture and the original audio mixture to enforce systematic differences between each audio source of the plurality of audio sources within the reconstructed audio mixture and the original audio mixture;

minimize a coherence loss between reconstructed audio mixture is coherent with respect to the original audio mixture; and minimize a frequency consistency loss between a magnitude spectrogram of the original audio mixture and a magnitude spectrogram of the reconstructed audio mixture.

8. The system of claim 1, wherein the memory includes instructions which, when executed, further cause the processor to:

obtain a mixture spectrogram representative of a spectral domain of the reconstructed audio mixture and a mixture spectrogram representative of a spectral domain of the original audio mixture.

9. The system of claim 1, wherein the memory includes instructions which, when executed, further cause the processor to:

constrain each source-specific latent feature to a respective latent feature manifold with each update.

10. The system of claim 1, wherein the memory includes instructions which, when executed, further cause the processor to:

apply a regularizer to an output of each source-specific data prior for each respective audio source of a plurality of audio sources.

11. A method for audio source separation, the method comprising:

synthesizing, by a processor, a reconstructed audio mixture through additive mixing of a plurality of audio samples generated by a plurality of source-specific data priors based on a plurality of source-specific latent features of a plurality of audio sources of an original audio mixture;

iteratively updating, by the processor, the plurality of source-specific latent features through optimization of a spectral-domain loss function between a spectrogram of the reconstructed audio mixture and a spectrogram of the original audio mixture; and obtaining, by the processor, a final estimation of each audio source of the original audio mixture based on each source-specific data prior and the updated plurality of source-specific latent features.

12. The method of claim 11, further comprising:

generating, by a source-specific data prior generator, a source-specific data prior for each respective audio source of a plurality of audio sources of an original audio mixture based on a plurality of source-specific latent features of the original audio mixture.

13. The method of claim 12, wherein the source-specific data prior generator is a generative adversarial network configured to generate a source-specific audio sample based on the source-specific latent features of the original audio mixture.

14. The method of claim 13, further comprising:

sampling a source-specific audio sample from each respective source-specific data prior of the plurality of source-specific data priors.

15. The method of claim 11, further comprising:

generating the reconstructed audio mixture by additive mixing of each of the plurality of sampled source-specific audio samples obtained using each respective source-specific data prior of the plurality of source-specific data priors.

16. The method of claim 11, further comprising:

applying projected gradient descent to the spectral domain loss function that uses the spectrogram of the reconstructed audio mixture and the spectrogram of the original audio mixture to update the plurality of source-specific latent features.

17. The method of claim 16, further comprising:

minimizing a multiresolution spectral loss between log magnitudes of the spectrogram of the reconstructed audio mixture and the spectrogram of the original audio mixture at varying spatial resolutions between the original audio mixture and the reconstructed audio mixture;

minimizing an aggregated gradient similarity loss between each respective spectrogram of the reconstructed audio mixture and the original audio mixture to enforce systematic differences between each audio source of the plurality of audio sources within the reconstructed audio mixture and the original audio mixture;

minimizing a coherence loss between reconstructed audio mixture is coherent with respect to the original audio mixture; and minimizing a frequency consistency loss between a magnitude spectrogram of the original audio mixture and a magnitude spectrogram of the reconstructed audio mixture.

18. The method of claim 11, further comprising:

obtain a mixture spectrogram representative of a spectral domain of the reconstructed audio mixture and a mixture spectrogram representative of a spectral domain of the original audio mixture.

19. The method of claim 11, further comprising:

constraining each source-specific latent feature to a respective latent feature manifold with each update.

20. The method of claim 11, further comprising:

applying a regularizer to an output of each source-specific data prior for each respective audio source of a plurality of audio sources.

* * * * *